US008925980B2

(12) United States Patent
Heikintupa et al.

(10) Patent No.: US 8,925,980 B2
(45) Date of Patent: Jan. 6, 2015

(54) METHOD AND ARRANGEMENT FOR OPENING AND CLOSING A SUSPENDED CEILING OF AN ELEVATOR CAR, AND LOCKING DEVICE

(75) Inventors: Rami Heikintupa, Haapamäki (FI); Pekka Halonen, Tervakoski (FI)

(73) Assignee: Kone Corporation, Helsinki (FI)

( * ) Notice: Subject to any disclaimer, the term of this patent is extended or adjusted under 35 U.S.C. 154(b) by 37 days.

(21) Appl. No.: 13/333,418

(22) Filed: Dec. 21, 2011

(65) Prior Publication Data

US 2012/0085032 A1 Apr. 12, 2012

Related U.S. Application Data

(63) Continuation of application No. PCT/FI2010/050565, filed on Jun. 30, 2010.

(30) Foreign Application Priority Data

Jul. 3, 2009 (FI) ..... 20090264

(51) Int. Cl.

| | |
|---|---|
| ***E05C 19/10*** | (2006.01) |
| ***E04B 9/00*** | (2006.01) |
| ***B66B 11/02*** | (2006.01) |
| *E05C 3/16* | (2006.01) |

(52) U.S. Cl.

CPC ..... *B66B 11/0226* (2013.01); *E04B 9/003* (2013.01); *Y10S 292/04* (2013.01); *Y10S 292/36* (2013.01)

USPC .. 292/99; 292/225; 292/DIG. 4; 292/DIG. 36

(58) Field of Classification Search

USPC ..... 52/19, 32; 292/63–67, 95, 109–111, 292/113, 114, 341.15, 341.17, 80–83, 85, 292/87, 89, 96–99, 101–103, 107, 108, 292/121–126, 128, 194–198, 219, 220, 292/222–226, 228, DIG. 36, 200, 202–204, 292/209, 210, 304, DIG. 11, 332, 336, 292/DIG. 4, 229; 49/394; 187/313, 314, 401

See application file for complete search history.

(56) References Cited

U.S. PATENT DOCUMENTS

| | | | | |
|---|---|---|---|---|
| 1,299,596 | A * | 4/1919 | Moore et al. | 292/78 |
| 1,493,794 | A * | 5/1924 | Robertson | 292/99 |

(Continued)

FOREIGN PATENT DOCUMENTS

| | | |
|---|---|---|
| EP | 0982454 A1 | 3/2000 |
| EP | 1950166 A1 | 7/2008 |

(Continued)

*Primary Examiner* — Kristina Fulton
*Assistant Examiner* — Alyson M Merlino
(74) *Attorney, Agent, or Firm* — Harness, Dickey & Pierce, P.L.C.

(57) ABSTRACT

The object of the invention is a method and an arrangement for opening and closing a suspended ceiling or corresponding of an elevator car and also a locking device. The suspended ceiling or corresponding is supported in place at least partly by one or more locking devices. In the method the suspended ceiling or corresponding is opened from its locking and lowered away from its position and fixed again into its position. In the opening phase of the suspended ceiling the locking devices supporting the suspended ceiling are pre-tuned into a state where the suspended ceiling continues to stay in place in the upper position and after pre-tuning the suspended ceiling is released from its locking by lifting the suspended ceiling first upwards and after this by letting the suspended ceiling lower downwards.

15 Claims, 6 Drawing Sheets

(56) References Cited

U.S. PATENT DOCUMENTS

| | | | | | |
|---|---|---|---|---|---|
| 1,509,780 | A | * | 9/1924 | Robertson | 292/198 |
| 1,724,438 | A | * | 8/1929 | Vance | 292/198 |
| 2,013,285 | A | * | 9/1935 | Mooney | 292/79 |
| 2,020,277 | A | * | 11/1935 | Elwell | 292/71 |
| 2,177,275 | A | * | 10/1939 | Bird | 49/203 |
| 2,493,016 | A | * | 1/1950 | Nottingham | 292/198 |
| 2,637,576 | A | * | 5/1953 | Nottingham | 292/99 |
| 2,660,765 | A | * | 12/1953 | Carlson | 49/205 |
| 2,794,664 | A | * | 6/1957 | Kruger | 292/129 |
| 2,817,554 | A | * | 12/1957 | Hasselmark | 292/340 |
| 2,868,577 | A | * | 1/1959 | Zingone | 292/99 |
| 2,929,648 | A | * | 3/1960 | Bobrick | 292/99 |
| 2,954,252 | A | * | 9/1960 | Carpenter | 292/110 |
| 3,131,958 | A | * | 5/1964 | Dunckel | 292/99 |
| 3,184,017 | A | | 5/1965 | Gravenor | |
| 3,189,374 | A | * | 6/1965 | Mertes | 292/80 |
| 3,189,936 | A | * | 6/1965 | Lee | 16/82 |
| 3,348,867 | A | * | 10/1967 | Stubblefield et al. | 292/122 |
| 3,352,586 | A | * | 11/1967 | Hakanson | 292/225 |
| 3,399,921 | A | * | 9/1968 | Trost et al. | 410/69 |
| 3,451,702 | A | * | 6/1969 | Little | 292/99 |
| 3,584,907 | A | * | 6/1971 | Mertes | 292/336 |
| 3,830,554 | A | * | 8/1974 | Moussaian et al. | 312/30 |
| 3,854,784 | A | * | 12/1974 | Hunt et al. | 312/9.63 |
| 4,529,351 | A | * | 7/1985 | Olins | 414/545 |
| 4,641,747 | A | * | 2/1987 | Mestdagh et al. | 206/308.1 |
| 4,971,587 | A | * | 11/1990 | Uchida et al. | 440/77 |
| 5,401,067 | A | * | 3/1995 | Kurosaki et al. | 292/63 |

FOREIGN PATENT DOCUMENTS

| | | | |
|---|---|---|---|
| FR | 2676773 | A1 | 11/1992 |
| GB | 952981 | A | 5/1964 |
| GB | 1201470 | A | 8/1970 |
| JP | 2001316061 | A | 11/2001 |
| JP | 2005104692 | A | 4/2005 |

* cited by examiner

METHOD AND ARRANGEMENT FOR OPENING AND CLOSING A SUSPENDED CEILING OF AN ELEVATOR CAR, AND LOCKING DEVICE

CROSS-REFERENCE TO RELATED APPLICATIONS

This application is a continuation of International application number PCT/FI2010/050565 filed on Jun. 30, 2010 and claims priority to Finnish application number FI 20090264, copy of each of which is hereby incorporated by reference.

BACKGROUND

1. Field

The object of the invention is a method and an arrangement for opening and closing a suspended ceiling or corresponding of an elevator car and also a locking device.

Hereinafter the method, arrangement and locking device according to the invention are jointly referred to as the solution according to the invention.

2. Description of Conventional Art

The ceiling, i.e. the suspended ceiling, of an elevator car often comprises a plurality of luminaires for illuminating the elevator car. The lamps of these luminaires must be changed from time to time. Additionally, the space between the suspended ceiling and the roof often comprise various devices that need to be serviced periodically. For this reason access to the space between the suspended ceiling and the roof is in practice an absolute requirement. Access is often arranged from below, in which case the suspended ceiling of the car must be somehow lowered down to enable access.

In prior-art solutions a screw fixing, for example, is generally used, in which case the suspended ceiling of the elevator car is fixed into position by means of a number of screws. A problem in these solutions is that it is difficult for one person to open the suspended ceiling because the more he/she opens the screws, the more the ceiling tends to open at the same time and often warps downwards unevenly. It is difficult for one person to open the ceiling from one side of the ceiling and at the same time to prevent the ceiling from falling on the other side. This is a big problem particularly with large ceilings. It is also difficult for one person to fix the suspended ceiling back into position. Thus generally, for example, for this reason at least two persons are needed for changing a lamp. Another drawback is the slowness of opening and re-fixing the suspended ceiling because there are so many screws to be opened and fastened. One drawback is also that fastening of some fixing screws can easily be forgotten in the fixing phase, in which case the fixing of the suspended ceiling weakens and the suspended ceiling may, as a result of vibration and other stress, suddenly fall down on top of the passengers of the elevator.

Prior art also includes solutions, in which a suspended ceiling, is fixed into position e.g. by means of fixing elements to be turned around the vertical axis, which elements form a horizontal support surface. When it is desired to lower the suspended ceiling down, the fixing elements are turned around their vertical axis, e.g. approx. 90 degrees, in which case the fixing elements turn away from their support surface and the suspended ceiling can be lowered down. A problem in this solution also is that it is difficult for one person to open the suspended ceiling because the more he/she opens the fixing elements, the more the ceiling tends to open at the same time and often warps downwards unevenly. It is then difficult for one person to open the ceiling from one side of the ceiling and to prevent at the same time the ceiling from falling on the other side. It is also difficult for one person to fix the suspended ceiling back into position. One drawback also in this solution is that fixing of some fixing elements can easily be forgotten in the fixing phase, in which case the fixing of the suspended ceiling weakens and the suspended ceiling may, as a result of vibration and other stress, suddenly fall down on top of the passengers of the elevator. Another problem is that if the fixing elements are only supported by the surface below them, the fixing elements can produce noise when the elevator travels, which noise is caused by various vibrations of the elevator car.

SUMMARY

The aim of this invention is to eliminate the aforementioned drawbacks and to achieve a simple, inexpensive, safe and reliable locking device and method, and also an arrangement for opening and closing the suspended ceiling or corresponding of an elevator car by means of the aforementioned locking device.

The methods, arrangements and locking devices that implement the invention will be described later. The basic concept of the invention is to apply a pre-tuned locking device, which after the pre-tuning opens with a separate movement. Pre-tuning according to the invention can also be performed to apply to the closing of the locking such that the locking requires pre-tuning of the locking device.

In a preferred embodiment of the invention, in the opening phase of the suspended ceiling or corresponding of the elevator car, the locking devices supporting the suspended ceiling or corresponding are pre-tuned into a state in which the suspended ceiling or corresponding continues to remain in place in the upper position, and after pre-tuning the suspended ceiling or corresponding is released from its locking by lifting the suspended ceiling or corresponding first upwards and after that letting the suspended ceiling or corresponding descend downwards.

In a preferred embodiment of the invention the locking means or fixing means of the suspended ceiling or corresponding of the elevator car comprise at least pre-tuning machinery that is fitted to be pre-tuned at least in the opening or fixing phase of the suspended ceiling or corresponding.

A preferred embodiment of the invention is a locking device, which comprises at least pre-tuning machinery, which is fitted to be pre-tuned at least in the opening or fixing phase of the suspended locking device.

Some inventive embodiments are also discussed in the descriptive section of the present application. The inventive content may also consist of several separate inventions, especially if the invention is considered in the light of expressions or implicit sub-tasks or from the point of view of advantages or categories of advantages achieved. In this case, some of the attributes below may be superfluous from the point of view of separate inventive concepts. Likewise the different details presented in connection with each embodiment of the invention can also be applied in other embodiments. In addition it can be stated that at least some features can at least in some situations be deemed to be inventive in their own right.

One advantage of the solution according to the invention is that owing to its pre-tuning the solution according to the invention is easy and safe to use. The element to be locked, whether it is a suspended ceiling of an elevator car, a louver hinged at one edge or a totally detachable and re-fixable plate, case, cubicle or corresponding, is easy to pre-tune in the opening, detaching or locking phase and then either the opening, detaching or locking can be performed with one movement. In this way the opening and re-fixing of even a large element, e.g. a suspended ceiling of an elevator car that is hinged at one edge, can be performed by one person with one movement easily, quickly and safely. One advantage also is that in the locking phase the element cannot be fixed in such a way that one of the fixing elements would not be closed. Owing to the pre-tuning, the element to be fixed, e.g. a suspended ceiling or corresponding of an elevator car, does not go into the locking position unless all the locking means are pre-tuned into the locking position. Thus such a situation cannot occur where the fixing of the suspended ceiling of an elevator car could fail due to a defective locking. Another advantage is that, particularly in an elevator car, the coupling element used for pre-tuning of the locking devices of the suspended ceiling remains hidden from sight in the gap between the suspended ceiling and the side wall. In this case there is nothing visible on the elevator car side, so the visual appearance of the ceiling of the elevator car can be freely designed. Additionally, the coupling elements are in secure from inappropriate usage because only the people who know where the coupling elements are can open them. A further advantage is also that the opening, and possibly also closing, of the suspended ceiling can be performed from outside the elevator car. Thus, for example, inappropriate opening of the suspended ceiling is not at all possible. Another advantage in this solution is that in some cases also access to the elevator car and also egress from the elevator car can be enabled when travel through the doors of the elevator car is not for some reason possible.

BRIEF DESCRIPTION OF THE DRAWINGS

In the following, the invention will be described in more detail by the aid of an example of its embodiment with reference to the attached drawings, wherein.

DETAILED DESCRIPTION

Figure 1:
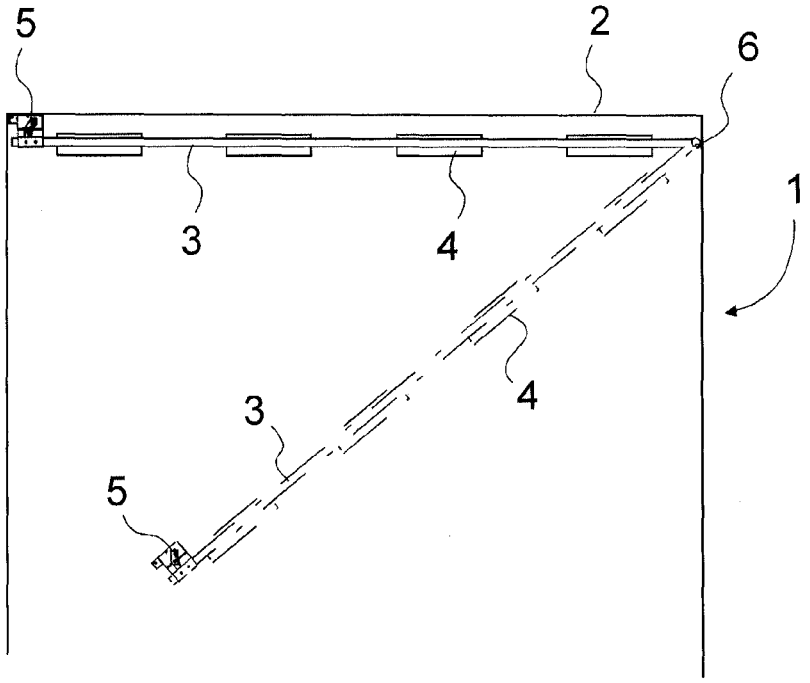
FIG. 1 presents a simplified and diagrammatic side view of a top part of an elevator car, in which a suspended ceiling that opens from the edge and that is equipped with luminaires and locking devices according to the invention is seen in its normal position with solid lines and as partly lowered with dot-and-dash lines.

FIG. 1 presents a simplified and diagrammatic side view of the top part of an elevator car 1, in which the suspended ceiling 3 of an elevator car 1, which ceiling is equipped with luminaires 4 and locking devices 5 according to the invention, which locking devices function as locking means or fixing means, and which ceiling opens from its first edge and is equipped with hinges 6 on its second edge, is seen in its normal position, i.e. in its upper position, with solid lines and as partly lowered with dot-and-dash lines. The bottom edge of the roof of the elevator car 1 is marked with the reference number 2. The locking of the suspended ceiling 3 into its, normal operating position is implemented with locking devices 5 that are disposed on the top surface of the suspended ceiling 3, in the proximity of the edge on the opposite side to the hinges 6 of the suspended ceiling 3, and that are disposed on the side edge of the suspended ceiling 3, of which locking devices there are in total e.g. two, one on each side edge. The top part of the locking device 5 is either on the bottom surface 2 of the roof of the elevator car 1 or in any other suitable fixed location in the elevator car above the suspended ceiling 3.

Figure 2:
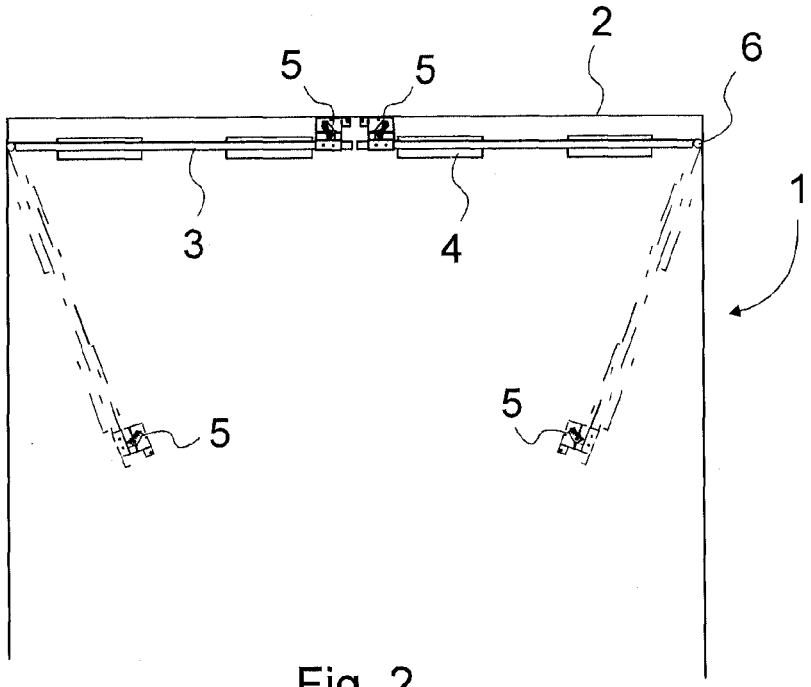
FIG. 2 presents a simplified and diagrammatic side view of a top part of an elevator car, in which a center-opening suspended ceiling that is equipped with luminaires and locking devices according to the invention is presented in its normal position with solid lines and as partly lowered with dot-and-dash lines.

FIG. 2 presents a simplified and diagrammatic side view of the top part of an elevator car 1, in which a centre-opening suspended ceiling 3 that is equipped with luminaires 4 and locking devices 5 according to the invention is seen in its normal position with solid lines and as partly lowered with dot-and-dash lines. In this case the suspended ceiling 3 is of two parts and is hinged with hinges 6 at its end on the side of the side walls of the elevator car 1 for opening from the centre of the elevator car 1. The locking of the suspended ceiling 3 into its normal operating position is implemented with locking devices 5 that are disposed on the top surface of the suspended ceiling 3, in the proximity of the edge on the opposite side to the hinges 6 of the suspended ceiling 3, and that are disposed on the side edge of the suspended ceiling 3, of which locking devices there are in total e.g. two on the half section of the suspended ceiling 3, one on each side edge of the half section of the suspended ceiling 3. The top part of the locking device 5 is either on the bottom surface 2 of the roof of the elevator car 1 or in any other appropriate fixed location in the elevator car above the suspended ceiling 3.

When the suspended ceiling 3 is lowered down, e.g. a new lamp can be changed to replace a dead one or the devices between the suspended ceiling 3 and the bottom surface 2 of the roof can be repaired or serviced. Additionally, a lowered suspended ceiling 3 enables, if necessary, access to the elevator car 1 or egress from the elevator car via the louver in the roof. The suspended ceiling 3 can also be opened and closed from outside the car, e.g. from the top of the roof, by means of a special transmission means or other corresponding opening or closing means.

Figure 3:
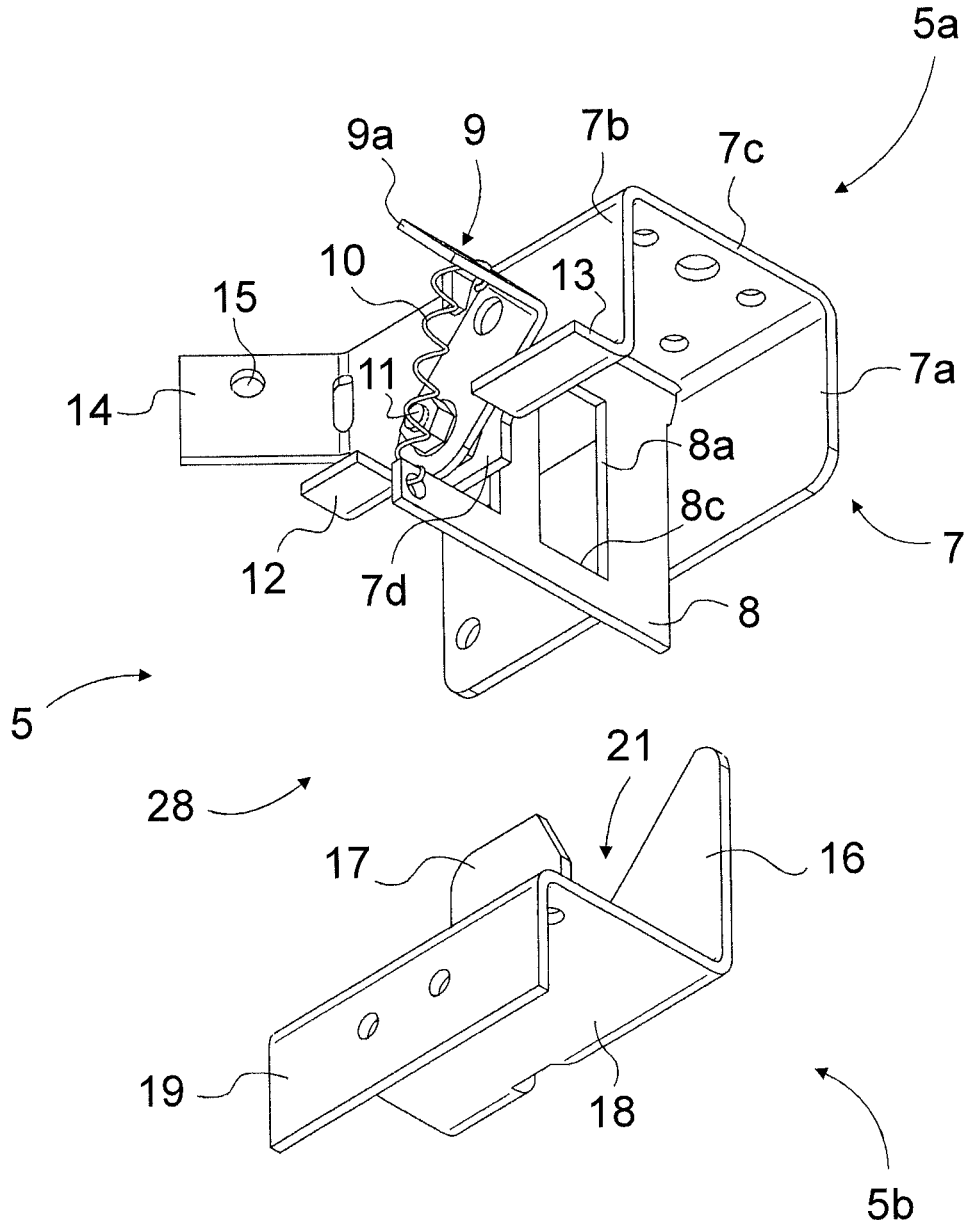
FIG. 3 presents an oblique bottom view of one locking device according to the invention in its open position and detached from its operating environment.
Figure 4:
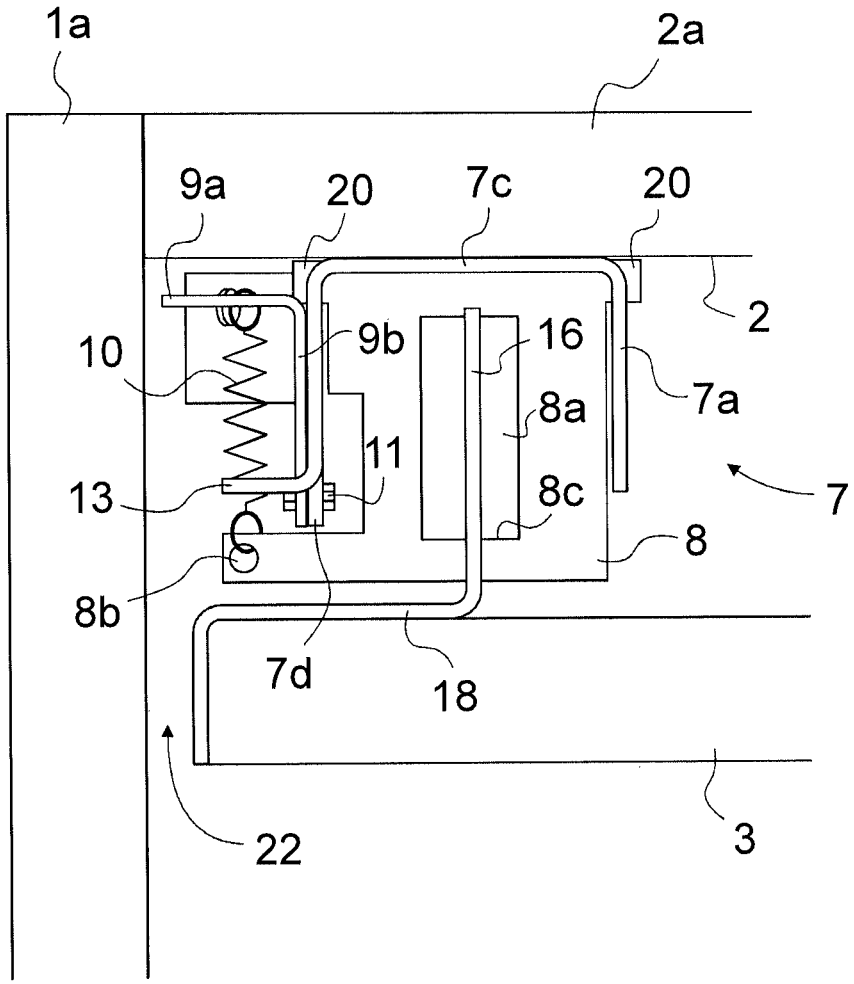
FIG. 4 presents an end view of one locking device according to the invention in its closed position.

FIGS. 3 and 4 present in more detail one locking device 5 according to the invention that functions as a locking means or fixing means. FIG. 3 presents the locking device 5 in its open position and detached from its operating environment, as viewed obliquely from below. Correspondingly, FIG. 4 presents an end view of the locking device 5 in its closed position and in connection with its operating environment. The locking device 5 comprises two halves, the first half, i.e. the top half, 5*a* of which is fixed e.g. to the bottom surface 2 of the roof of the elevator car 1 or to some other point in the elevator car suited to the purpose, and the second half, i.e. the bottom half 5*b*, is fixed to the top surface of the lowerable suspended ceiling 3 of the elevator car 1.

The top half 5*a* of the locking device 5 comprises at least a frame part 7 that is bent e.g. from a metal sheet and consists of, as viewed from the end, two essentially downward-pointing side walls 7*a*, 7*b* and a roof 7*c* connecting the side walls at their top ends. The top half 5*a* is fixed to its base from the roof 7*c* of the frame part 7, e.g. to the bottom surface 2 of the roof 2*a* of the elevator car. The bottom part of the second side wall 7*b* comprises a straight fixing part 7*d* in the centre, which part continues in the direction of the side wall 7*b* essentially in the vertical direction to the bottom edge of the side wall 7*b*. Instead of that, the starting end and the finishing end of the bottom part of the side wall 7*b* comprise bendings 12 and 13 pointing outwards from the side wall 7*b*, between which bendings remains a gap in the longitudinal direction of the frame part 7, which gap is at least the same width as the fixing part 7*d*.

A locking means 8 that is e.g. a sheet-like object of uniform thickness, the centre part of which comprises an aperture 8*a* comprising an essentially straight bottom edge 8*c*, which locking means is fitted to move back and forth inside the frame part 7, is fixed in a hinged manner at its top end to the frame part 7. The locking means 8 is fitted to move back and forth supported by its joint 20 in the longitudinal direction of the frame part 7 the distance of an angle, the magnitude of which is suitably smaller than 180°. A coupling element 9 that is fixed from its bottom end in a hinged manner with a joint 11, which coupling element is bent to a shape of an upside-down letter L when viewed from the end of the frame part 7, in which coupling element the first arm 9*a*, i.e. the top end, extends away from the frame part 7 and the second arm 9*b* is essentially in the direction of the second side wall 7*b* of the frame part 7, is disposed between the bendings 12 and 13 on the second side wall 7*b* of the frame part 7 to move the locking means 8. The joint 11, e.g. a screw-nut-combination disposed in a loose hole, is in the hole that is at the bottom end of the second arm 9*b* of the coupling element 9. The edges of the bendings 12 and 13 pointing against each other form detent surfaces and thus movement limiters for the movement of the coupling element 9 that is disposed between the bendings 12 and 13.

The top edge of the frame part 7 comprises a protrusion 14 as an extension of the second side wall 7*b* of the frame part 7, which protrusion is suitably bent outwards from the plane formed by the side wall 7*b*. The protrusion 14 comprises a hole 15, via which a transmission means, such as a steel wire, that functions as an opening and closing wire is guided to pass from outside the elevator car 1, e.g. from the top of the roof of the elevator car to the coupling element 9 for turning the coupling element 9 into the opening position and closing position of the locking device 5.

The top half 5*a* of the locking device is also equipped with a draw-spring 10 or corresponding means producing tensile stress. The first end, i.e. the top end, of the draw-spring 10 is fixed to the holes at the top end 9*a* of the coupling element 9 and the second end, i.e. the bottom end, is fixed to the hole 8*b* in the bottom end of the locking means 8.

The bottom half 5*b* of the locking device is essentially of uniform thickness, e.g. an object bent from a metal sheet, which comprises a locking part 16 and a control part 17 that is essentially on the same vertical plane, as well as a base part 18 bent at a right angle with respect to the locking part 16 and the control part 17, and further a fixing part 19 bent at a right angle with respect to the base part 18. Between the locking part 16 and the control part 17 is a guide slot 21 functioning as the jaw of the locking device, along which guide slot the bottom part of the locking means 8 is guided into the locking position and out of the locking position.

The bottom half 5*b* is fixed from its base part 18 to the top surface of the suspended ceiling 3 of the elevator car and for the sake of safety also to the side edge from its fixing part 19. The locking part 16 is fitted to point essentially vertically upwards from the top surface of the suspended ceiling 3 when the suspended ceiling 3 is in its closed position. The bottom half 5*b* of the locking device 5 is disposed with respect to the top half 5*a* such that when the suspended ceiling 3 is in the closed position, the locking part 16 is at the point of the aperture 8*a* of the locking means 8 when viewed from the end, and in the guide slot 21 when viewed from the side.

In order to facilitate the opening and fixing into position of the suspended ceiling 3, the locking device 5 comprises pre-tuning machinery 28, which comprises at least the locking means 8 in the top half 5*a* of the locking device 5, a coupling element 9 and a draw-spring 10 as well as a locking part 16 in the bottom half 5*b* of the locking device 5, to which locking part the locking means 8 is fitted to lock.

FIG. 4 presents a detail of the fixing of the locking device 5 to the structures of the elevator car 1. The roof 2*a* of the elevator car 1 is larger in terms of its surface area than the suspended ceiling 3 such that when the side wall 1*a* is fixed to the roof 2*a* and the suspended ceiling 3 is in place, a gap 22 remains between the suspended ceiling 3 and the inner surface of the side wall 1*a*, through which gap there is a connection to the top end 9*a* of the coupling element 9 in the top half of the locking device 5 for moving the coupling element 9 around its joint 11.

Figure 5:
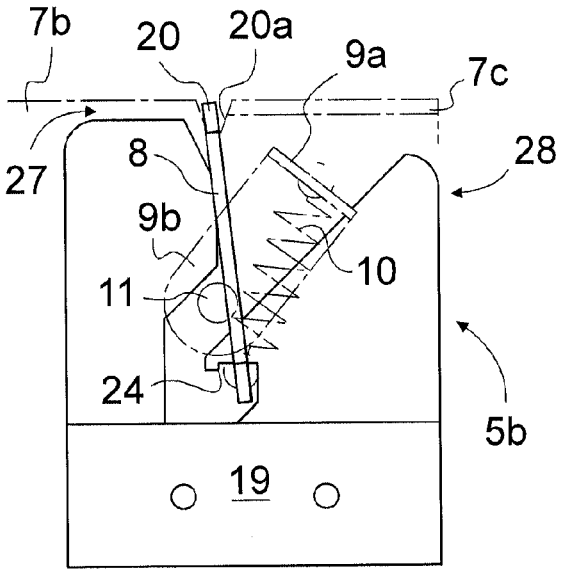
FIG. 5 presents a simplified and diagrammatic side view of one locking device according to the invention in its closed position.
Figure 5A:
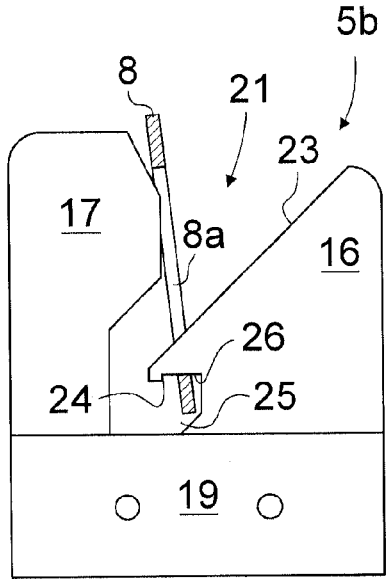
FIG. 5*a* presents a further simplified side view of a locking device according to the invention in the situation presented in FIG. 5.

FIGS. 5-10 present the locking device 5 according to the invention in its different phases of operation simplified so that the position of the locking means 8 and the movement is as visible as possible. FIGS. 5 and 5*a* present the same situation as each other but with the difference that in FIG. 5*a* all the other parts except the bottom-half 5*b* of the locking device 5 and the locking means 8 are removed for the sake of clarity. The same removal has also been done in FIGS. 6*a*, 7*a* and 8*a*. In all the FIGS. 5*a*, 6*a*, 7*a* and 8*a* the locking means 8 is additionally cross-sectioned at the point of the aperture 8*a*, whereas in FIGS. 5, 6, 7, 8, 9 and 10 the locking means 8 is not cross-sectioned.

In FIGS. 5 and 5*a* the locking device 5 is in its closed position, in which case the suspended ceiling 3 is locked into its upper position. In this case the coupling element 9 is turned around the joint 11 into the closed position, into its extreme position to the right and the top end of the draw-spring 10 is also in its extreme position on the right. The fixing point of the ends of the draw-spring 10 at the bottom end of the locking means 8 and at the top end of the coupling element 9, the direction of the spring force of the draw-spring, the location of the joint 11 of the coupling element 9, and the location 20*a* of the joint fixing 20 in the top part of the locking means 8 in the top part of the top half 5*a* of the locking device 5 are mutually selected so that the spring force of the draw-spring 10 pulls the bottom end of the locking means 8, in the recess 25 of the bottom part of the jaw 21 both deeper into the recess 25, i.e. to the right in the figure, and also upwards towards the top edge 26 of the recess 25, on which edge the bottom edge 8*c* of the aperture 8*a* of the locking means 8 rests. In this case the locking device 5 stays reliably in its closed position and at the same time the locking means 8 keeps the suspended ceiling 3 of the elevator car in its upper position.

The locking device 5 is further dimensioned such that between the top surface of the roof 7*c* of the frame part 7 of the top half 5*a* of the locking device 5, i.e. in practice the bottom surface 2 of the roof 2*a* of the elevator car 1, or other corresponding fixed surface and the highest point of the bottom half 5*b* of the locking device 5 is a gap 27 that functions as a movement allowance in the direction of lifting, which gap is larger than the height of the protrusion 24 that functions as a detent at the free end of the top edge 26 of the recess 25. In this case the locking means 8 is able to pass past the protrusion 24 pulled by the draw-spring 10 when the suspended ceiling 3 and at the same time the bottom half 5*b* of the locking device 5 is lifted sufficiently towards the top half 5*a* of the locking device 5.

Figure 6:
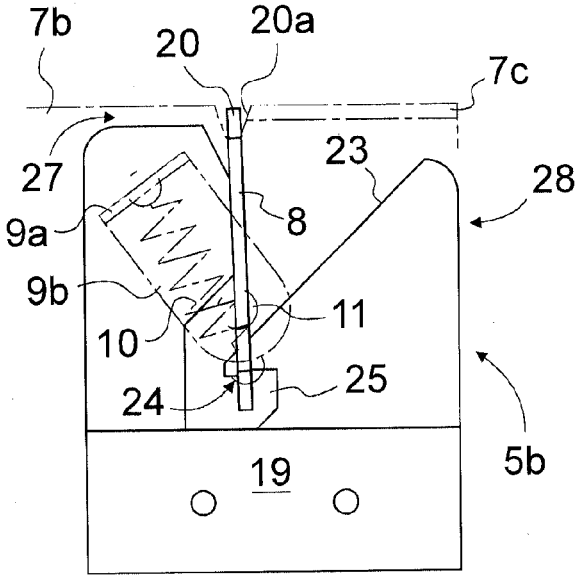
FIG. 6 presents a simplified and diagrammatic side view of one locking device according to the invention pre-tuned for opening.
Figure 6A:
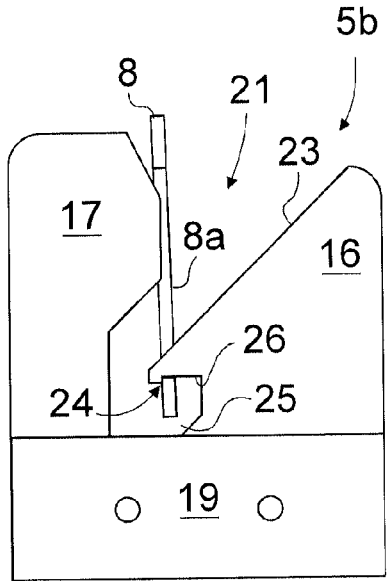
FIG. 6*a* presents a further simplified side view of a locking device according to the invention in the situation presented in FIG. 6.

In FIGS. 6 and 6*a* the locking device 5 is pre-tuned for opening the locking. In this case the coupling element 9 is turned around its joint 11 into its extreme position on the left, in which case the spring force of the draw-spring 10 has pulled the bottom end of the locking means 8 in the figures to the left until the bottom edge 8*c* of the aperture 8*a* of the locking means 8 has stopped at the protrusion 24 that functions as a detent at the free end of the top edge 26 of the recess 25. As the bottom end of the locking means 8 moves to the left in the recess pulled by the draw-spring 10, both the spring force of the spring and the weight of the suspended ceiling 3 keep the bottom edge 8*c* of the aperture 8*a* of the locking means 8 tightly resting against the top edge 26 of the recess 25 so that the locking means 8 is not able to turn past the protrusion 24 away from the recess 25. Thus the locking device 5 stays in this position in the pre-tuned position and the suspended ceiling 3 continues to stay in place. Owing to this, all the locking devices 5 keeping the suspended ceiling 3 in the upper position can now be pre-tuned ready for lowering the suspended ceiling 3 and the suspended ceiling 3 cannot, for example, fall from one corner prematurely. In this way only one person can alone also easily and safely open a suspended ceiling 3 that is large in size.

Figure 7:
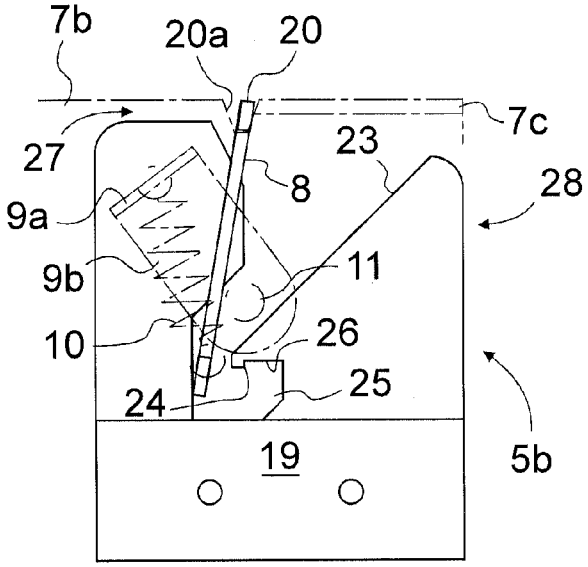
FIG. 7 presents a simplified and diagrammatic side view of one locking device according to the invention in a situation where the pre-tuning of the opening has just been removed.
Figure 7A:
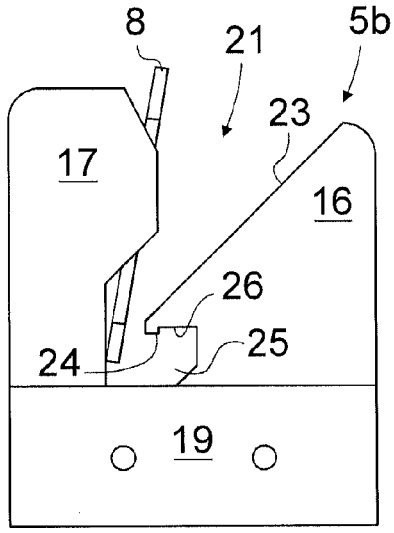
FIG. 7*a* presents a further simplified side view of a locking device according to the invention in the situation presented in FIG. 7.

In the case according to FIGS. 7 and 7*a*, all the locking devices 5 have been pre-tuned for opening and the final opening of the locking device 5 has been performed by lifting the suspended ceiling 3 upwards so much that the bottom end of the locking means 8 has been detached from the recess 25 behind the protrusion 24 pulled by the spring force of the draw-spring 10 and turned around the joint 20 of its top end, to the left in the figures, while being supported towards the jaw 21 side of the edge of the control part 17.

Figure 8:
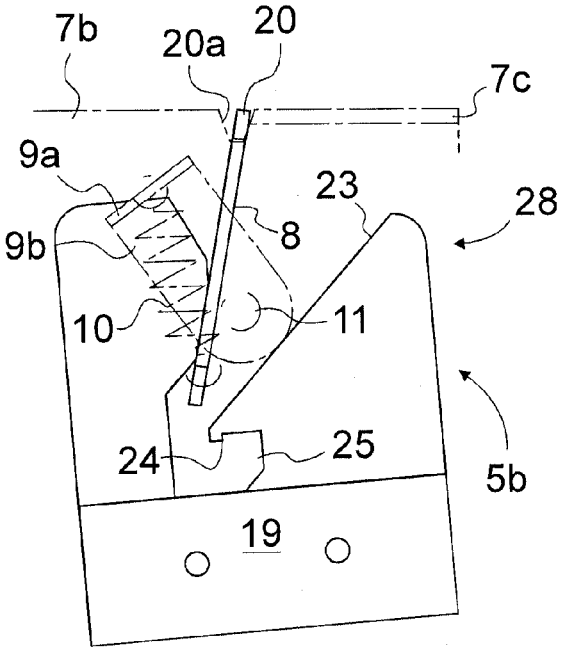
FIG. 8 presents a simplified and diagrammatic side view of one locking device according to the invention in a situation where the top part of the locking device detaches from the bottom part of the locking device.
Figure 8A:
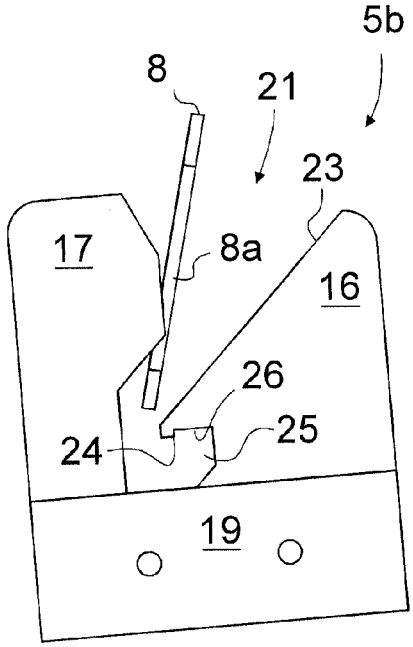
FIG. 8*a* presents a further simplified side view of a locking device according to the invention in the situation presented in FIG. 8.

In the case according to FIGS. 8 and 8*a* the opening movement of the suspended ceiling 3 is started, in which case the suspended ceiling 3 is lowered around its joint 6. Thus all the bottom ends of the pre-tuned locking means 8 are supported on the jaw 21 side of the edge of the control part 17 pulled by the spring force and the bottom halves 5*b* of the locking devices 5 can slide away from the top halves 5*a* of the locking devices.

Figure 9:
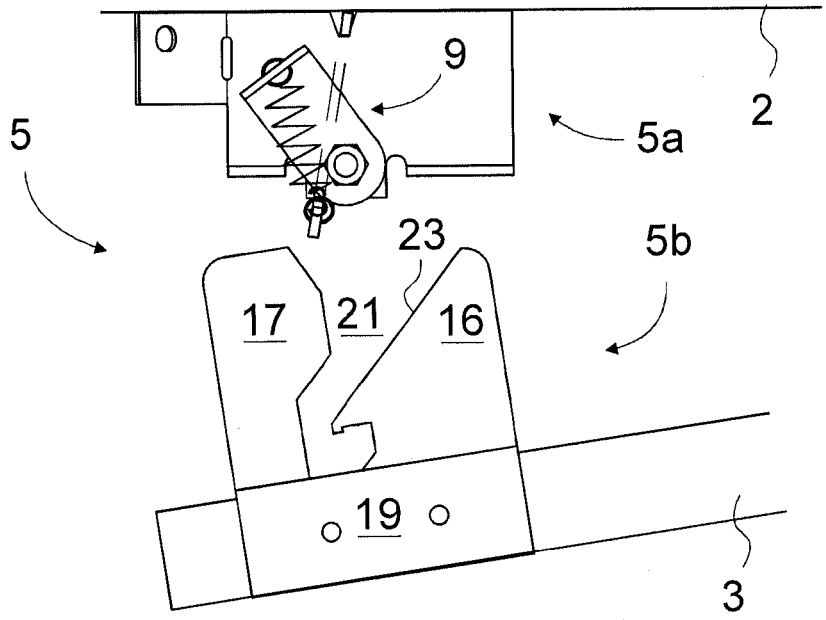
FIG. 9 presents a simplified and diagrammatic side view of one locking device according to the invention in a situation where the top part of the locking device is completely detached from the bottom part of the locking device.
Figure 10:
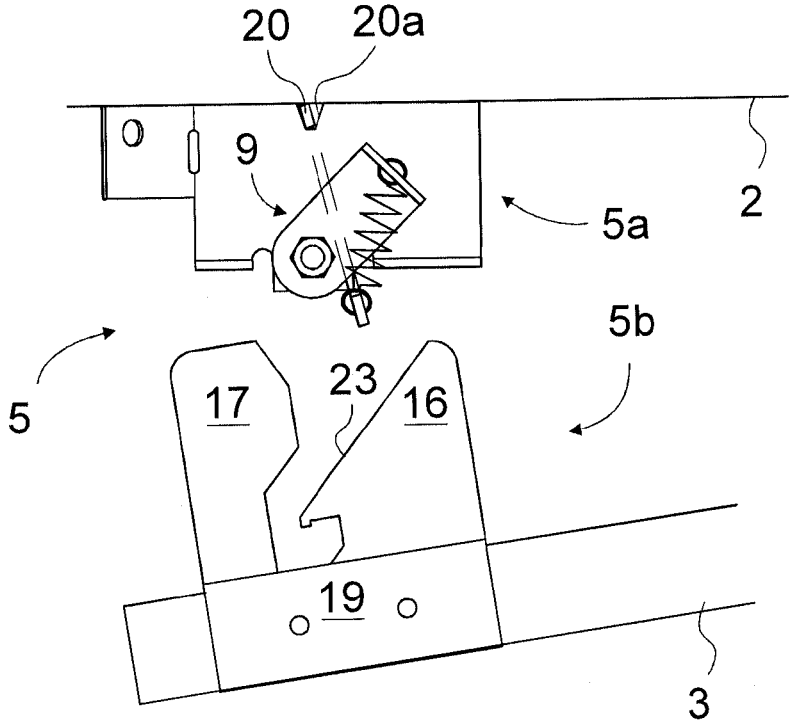
FIG. 10 presents a simplified side view of a locking device according to the invention in a situation where the top part of the locking device is tuned ready for re-locking.

FIG. 9 presents a situation in which the halves 5*a* and 5*b* of the locking device 5 are separated from each other and the suspended ceiling 3 can be lowered down. If were now endeavored to lock the suspended ceiling 3 while the coupling element 9 is turned to the left into its pre-tuning position for the opening purpose, the locking would not succeed. In this case the draw-spring 10 pulls the bottom end of the locking means 8 to the left all the time so that the bottom end of the locking means 8 is not able to go into the jaw 21 at all, but instead already gets caught by its bottom edge on the top edge of the control element 17. To prevent this, the locking devices 5 must be pre-tuned in the manner presented in FIG. 10 also before locking the locking devices 5. The pre-tuning function enables ensuring that not one of the locking devices 5 is accidentally left open while closing the suspended ceiling 3, because the suspended ceiling 3 cannot be brought all the way up at the point of those locking devices that are not pre-tuned.

The pre-tuning function also enables only one person to be able to lock even a large suspended ceiling 3 simply by lifting the suspended ceiling 3 supported by its hinges 6 towards the roof until the pre-tuned locking devices 5 click into a locked position and the suspended ceiling 3 locks at once into position. Pre-tuning in the locking phase takes place by turning the coupling element 9 again to the right into the locking position already before the actual locking event. In this way the bottom end of the locking means 8 tunes ready into the locking position, pulled by the draw-spring 10, after which when lifting the suspended ceiling 3 into position the bottom edge of the locking means 8 slides along the jaw 21 side of the oblique edge 23 of the locking part 16 into the recess 25 and locks, pulled by the spring force against the top edge 26 of the recess 25 behind the protrusion 24.

In the method according to the invention, the opening and locking of the suspended ceiling 3 is performed e.g. as follows. In the opening phase all the locking devices 5 of the suspended ceiling 3 are pre-tuned one by one by turning the coupling element 9 of each locking device 5 around its joint 11 into the opening position. Pre-tuning is performed from inside the elevator car 1 through the gap 22 between the suspended ceiling 3 and the inner wall 1*a* of the elevator car with some rod-like object, e.g. with a long-handled screwdriver. Alternatively, pre-tuning is performed from outside the elevator car, e.g. by means of a steel wire or corresponding, such as described above.

The suspended ceiling 3 still remains in place after the pre-tuning, and the bottom ends of the locking means 8 of the locking devices 5 are in the recesses 25 of the bottom halves 5*b* of the locking devices 5 behind the protrusions 24 and being supported against the top edge 26 of the recess 25.

When all the locking devices 5 are pre-tuned, the suspended ceiling 3 is opened by lifting the suspended ceiling 3 first upwards from the edge on the opposite side of the hinges 6, i.e. by pressing the bottom half 5*b* and the top half 5*a* of the locking device 5 against each other. In this way the bottom ends of the locking means 8 are released from behind the protrusions 24 and moved, owing to the spring force of the spring element 10, from the recess 25 to the free space of the jaw 21 on the other side of the protrusion 24. The opening of the suspended ceiling 3 is now continued by letting the suspended ceiling 3 come downwards under its own weight, in which case the top and bottom halves 5*a* and 5*b* of the locking means 5 are detached from each other. After this the suspended ceiling 3 can be lowered as low as is necessary to change lamps or perform maintenance work.

Correspondingly, before fixing the suspended ceiling 3 to the upper position all the locking devices 5 are pre-tuned by turning the coupling element 9 of each locking device 5 into the locking position to the right, in which case the locking means 8 at the same time turn into their locking position pulled by the spring force. The final locking takes place by lifting the suspended ceiling 3 upwards so much that the top and bottom halves 5*a* and 5*b* of the locking devices 5 are pressed against each other deep enough until the spring force of the draw-springs 10 pulls the bottom ends of the locking means 8 from the jaw 21 into the recess 25, and after the lifting force has been removed from the suspended ceiling 3 to continue to be supported on the top edges 26 of the recesses 25 from the bottom edges 8*c* of the apertures 8*a*.

It is obvious to the person skilled in the art that the different embodiments of the invention are not limited to the examples described above, but that they may be varied within the scope of this disclosure. Thus, for example, the structure of the locking device can also be different than what is described above.

It is further obvious that the locking device described above also suits another purpose than locking the suspended ceiling of the elevator car into its upper position. The locking device is suited for locking all hinged hatches, lids and corresponding, and also for fixing different unhinged objects, such as sheets, shelves and boxes onto either a horizontal, inclined or vertical surface.

The invention claimed is:

1. A method for opening and closing a suspended ceiling of an elevator car, the suspended ceiling being at least partially supported by one or more locking devices, the method comprising:

pre-tuning the one or more locking devices from a locking state, in which at least a part of the suspended ceiling is locked in a first position, to an unlocked state, in which at least the part of the suspended ceiling is releasable from, but held in, the first position by the one or more locking devices;

holding, after the one or more locking devices are pre-tuned to the unlocked state, at least the part of the suspended ceiling in the first position until at least the part of the suspended ceiling is released from the first position by being lifted upwards in a first direction and then lowered in a second direction;

releasing at least the part of the suspended ceiling from the first position by lifting at least the part of the suspended ceiling upwards in the first direction; and lowering at least the part of the suspended ceiling in the second direction to a second unlocked position.

2. The method according to claim 1, wherein the one or more locking devices are configured to enable a bottom portion of the one or more locking devices to be inserted into a top portion of the one or more locking devices, and wherein at least the part of the suspended ceiling is locked into the first position by lifting at least the part of the suspended ceiling upwards until the one or more locking devices are locked.

3. The method according to claim 1, wherein each of the one or more locking devices is configured to be switched between the unlocked state and the locking state by changing the direction of a spring force of a draw-spring that acts on a locking element that is coupled to a corresponding locking device by a coupling element.

4. The method according to claim 3, wherein the corresponding locking device is set in the unlocked state from inside the elevator car by moving the coupling element from a gap between the part of the suspended ceiling of the elevator car and a side wall by a substantially rigid object configured to fit into the gap.

5. The method according to claim 3, wherein the corresponding locking device is configured to be pre-tuned from outside the elevator car by moving the coupling element from outside the elevator car using a transmission device that is led to the coupling element.

6. An arrangement to open and close a suspended ceiling of an elevator car, the arrangement comprising:

a locking device configured to lock at least a part of the suspended ceiling in a first position, and to release at least the part of the suspended ceiling to enable at least the part of the suspended ceiling to be lowered into a second unlocked position; wherein the locking device includes pre-tuning machinery configured to pre-tune the locking device from a locking state, in which at least the art of the suspended ceiling is locked in the first position, to an unlocked state, in which at least the part of the suspended ceiling is releasable from, but held in, the first position by the locking device, in the unlocked state, the locking device is configured to hold at least the part of the suspended ceiling in the first position until at least the part of the suspended ceiling is released from the first position by being lifted upwards in a first direction and then lowered in a second direction, and after being released, at least the part of the suspended ceiling is configured to be lowered in the second direction to the second unlocked position.

7. The arrangement according to claim 6, wherein the pre-tuning machinery is configured to pre-tune the locking device in both an opening phase and a fixing phase of the suspended ceiling.

8. The arrangement according to claim 6, wherein the pre-tuning machinery comprises:

a locking element;

a coupling element;

a draw-spring having a first end fixed to the coupling element, and a second end fixed to the locking element; and a locking part configured to be fitted together with the locking element in the first position.

9. The arrangement according to claim 8, wherein:

a spring force of the draw-spring is configured to act on the locking element such that, in an opening phase of the suspended ceiling, the locking device releases at least the part of the suspended ceiling from the first position when at least the part of the suspended ceiling is lifted upwards in the first direction and then lowered down, and in a fixing phase of the suspended ceiling, the locking device locks at least the part of the suspended ceiling in the first position when at least the part of the suspended ceiling is lifted sufficiently upwards in the first direction.

10. The arrangement according to claim 6, wherein an amount of movement of a bottom portion of the locking device is limited in a direction of lifting, the amount of allowed movement being greater than a height of a protrusion functioning as a detent at a free end of a top edge of a recess.

11. A locking device comprising:

a first portion including at least a frame part and a locking element fitted to the frame part, the locking element being configured to pivot around a joint; and a second portion configured to be locked to said first portion, the second portion including a locking part configured to be fitted to the locking element; wherein at least the locking element and the locking part form part of pre-tuning machinery configured to pre-tune the locking device into a locking state, in which at least a part of a suspended ceiling is locked in a first position, and an unlocked state, in which at least the part of the suspended ceiling is releasable from, but held in, the first position by the locking device, and in the unlocked state, the locking device is configured to hold at least the part of the suspended ceiling in the first position until at least the part of the suspended ceiling is released from the first position by being lifted upwards in a first direction and then lowered in a second direction to a second unlocked position.

12. The locking device according to claim 11, wherein the pre-tuning machinery is configured to pre-tune the locking device in an opening phase and a fixing phase of the suspended ceiling.

13. The locking device according to claim 11, wherein the pre-tuning machinery comprises:

the locking element;

a coupling element;

a draw-spring having a first end fixed to the coupling element, and a second end fixed to the locking element; and the locking part.

14. The locking device according to claim 13, wherein:

a spring force of the draw-spring is configured to act on the locking element such that, in an opening phase of the suspended ceiling, the locking device releases at least the part of the suspended ceiling from the first position when pushing the second portion of the locking device against the first portion of the locking device, and then pulling the second portion away from the first portion, and in a fixing phase of the suspended ceiling, the pre-tuned locking device locks at least the part of the suspended ceiling in the first position when pushing the second portion of the locking device against the first portion of the locking device.

15. The locking device according to claim 14, wherein an amount of movement of the second portion of the locking device is limited, the amount of allowed movement being greater than a height of a protrusion functioning as a detent at a free end of a top edge of a recess.

* * * * *